US006520107B1

(12) United States Patent
Hickok

(10) Patent No.: US 6,520,107 B1
(45) Date of Patent: Feb. 18, 2003

(54) CHAMBERED HULL BOAT DESIGN METHOD AND APPARATUS

(76) Inventor: William L. Hickok, 803 Harris Ave. Suite 9, Bellingham, WA (US) 98225

( * ) Notice: Subject to any disclaimer, the term of this patent is extended or adjusted under 35 U.S.C. 154(b) by 0 days.

(21) Appl. No.: 09/642,113

(22) Filed: Aug. 18, 2000

Related U.S. Application Data

(60) Provisional application No. 60/149,957, filed on Aug. 19, 1999.

(51) Int. Cl.[7] ..... B63B 3/00
(52) U.S. Cl. ..... 114/355; 114/356
(58) Field of Search ..... 114/345, 355; 441/35, 40

(56) References Cited

U.S. PATENT DOCUMENTS

| | | | | |
|---|---|---|---|---|
| 1,303,690 A | | 5/1919 | Leparmentier | |
| 2,560,153 A | | 7/1951 | Blount | |
| 3,140,686 A | | 7/1964 | Olivotti | |
| 3,261,038 A | * | 7/1966 | Klepper | 441/38 |
| 3,470,839 A | | 10/1969 | Faul et al. | |
| 4,046,092 A | | 9/1977 | Tornqvist | |
| 4,192,248 A | | 3/1980 | Moyer | |
| 4,348,972 A | | 9/1982 | Parsons | |
| 4,627,372 A | | 12/1986 | Douglas, III | |
| 4,667,618 A | | 5/1987 | Cigognetti | |
| 4,781,136 A | | 11/1988 | Van Der Velden | |
| 4,919,067 A | * | 4/1990 | Wenstob et al. | 114/345 |
| 5,078,072 A | | 1/1992 | Horiuchi et al. | |
| 5,184,566 A | | 2/1993 | Cochran | |
| 5,261,345 A | | 11/1993 | Fleming | |
| 5,546,886 A | | 8/1996 | Franceschelli et al. | |
| 5,699,749 A | | 12/1997 | Yamada et al. | |
| 6,024,042 A | | 2/2000 | Eilert | |

OTHER PUBLICATIONS

Stabi–Craft 525.
Stabi–Craft 1850XC.
Stabi–Craft 1997 Spring/Summer Retail Catalogue.

* cited by examiner

*Primary Examiner*—Jesus D. Sotelo
(74) *Attorney, Agent, or Firm*—Robert B. Hughes; Hughes Law Firm, PLLC

(57) ABSTRACT

A multichambered boat that is constructed upside-down on stationary platforms where flotation chambers are located in the perimeter portion of the multichambered boat. The perimeter chambers have a laterally downward sloping exterior surface that directs fluid downwardly and provides lift to the multichambered boat which creates a smoother ride. A fuel input line that passes through the flotation chamber to the fuel storage tank to provide convenient access for refueling the multichambered boat.

20 Claims, 6 Drawing Sheets

48
22
50
52
30
32a
42
32b
32e
44
46
32d
32c
30b
34
30a

CHAMBERED HULL BOAT DESIGN METHOD AND APPARATUS

This application claims the benefit of Provisional application Ser. No. 60,149,957, filed Aug. 19, 1999.

FIELD OF THE INVENTION

The invention relates to chambered water vessels and the location and design of chamber walls, and other design features. Further, the invention relates to a method of manufacture to produce the water vessels.

BACKGROUND

It is desirable to have watercrafts to remain afloat even when the open hull becomes filled of water. To make this possible discrete floatation chambers have been employed in watercraft for many years. Thus, in the event that the seal of one chamber is compromised and the buoyant effect of that chamber is lost, the other chambers will still have a buoyant effect so that the watercraft will remain afloat.

Due to the safety problems of punctured chambers the U.S. Coast Guard has implemented rigorous standards with which the boats under their jurisdiction must comply. One such regulation is the mandatory use of foam in the chambers to reduce the amount of water the chamber would take on in the event the chamber wall is punctured. There are many problems with foam injected chambers. First, it is very costly to inject foam into the chamber; the foam must be distributed evenly and the injection equipment is expensive to purchase and maintain. Secondly, If the foam filled chamber is punctured, repair of the chamber is difficult to impossible. It is somewhat difficult to remove the water that is soaked into the foam. Further, the aluminum wall that defines the chamber must be welded to recreate a sealed chamber and the heat from the welding process will melt the foam, creating noxious gas and leaving a portion of combusted foam no longer of use for floatation.

Another aspect of the design and manufacture of floatation boats is the construction of chambers has traditionally been accomplished by rolling sheets of aluminum to form a curved wall to define the chambers. There are numerous problems with the rolling process that results in variations in the shape and dimensions in the chamber walls. This lack of consistency makes the use of efficient manufacturing techniques difficult or in some instances impossible.

Another method of creating chamber walls is to extrude the aluminum through a mold to a preferred shape. This process is very expensive and can weaken the metal.

Yet another aspect related to the larger boats which generally have an internal combustion engine to power the prop, the fuel tank must reside in a safe place while still having a convenient access to the tank. The inlet port to refuel the tank has traditionally been in the back of the water vessels near the engine. Often times when a boat is in the water, the rear of a boat is lower than the front, because there is generally more load to the rear of the center of buoyancy of the water vessel. This position of the boat causes the gas to shift to the rear of the tank, which increases the hydrostatic pressure for a refueling inlet port located in the rear of the boat. This increase in pressure makes refueling more difficult

SUMMARY OF THE INVENTION

The invention is a multichambered boat having a central lower portion and a lateral portion where the central portion slopes upwardly from the laterally inwardly portion to the laterally outworked portion where it engages a perimeter contact surface that slopes laterally downwardly. The perimeter contact surface is part of a flotation chamber. The flotation chambers are located in the perimeter portion of the boat and provide buoyant lift. A fuel input line having an intake nozzle located in the upper portion of the flotation chamber and a central line extending through the chamber to an outtake nozzle located in the laterally inwardly portion of the chamber. The outtake nozzle is connected to a flexible close that is in communication to the fuel storage tank.

The multichambered boat hull is manufactured by utilizing stationery platforms having placement holders that are adapted to hold multi-creased wall sections that eventually form floatation chambers. Baffles are placed in between two adjacent multi-creased wall sections and are welded thereto to form discrete chambers.

One aspect of the invention is a strategic and precise placement of the chambers to minimize cost of construction and maintain a high level of safety in the event several chambers are punctured. The invention removes the need for costly foam injection chambers by placing the chambers at locations to reduce the risks in circumstances where multiple chambers are punctured.

Another aspect of the present invention is that each of the chambers are defined by a multi-creased wall that comprises a plurality of longitudinal creases or bends. The construction of the wall is accomplished by taking a flat piece of metal, preferably aluminum, and bend it about a longitudinal straight edge. This process is continued until the wall loops around to create a continuous tube like configuration, where the chamber has in cross sectional configuration the shape of an irregular polygon. This multi-creased wall is configured in a way so that it has an increased moment of inertia about the transverse axis, thus creating a stronger vessel. A majority of the bending moments on a water vessel are about the transverse axis, therefor increasing the moment of inertia about the transverse centroidal axis reduces the stresses experienced on the multi-creased walls and the water vessel as a whole.

After the multi-creased sections are formed they are assembled together in a rigid platform assembly to create very consistent dimensions of the final boats produced.

A further advantage of the preferred embodiment is a oblique surface in the lower portion of the multi-creased wall which has particular fluid flow advantageous by directing up-skirting water along the v-shaped hull in a downward direction, thus creating lift and a smoother ride for the passengers. This is beneficial in rough waters where the boat is impacting waves. The oblique surface can also assist in cornering as well. This oblique surface has the additional advantages of reducing the spray that is created when the water flows around the V-shaped wall in the lower hull.

The result is a light, safe high performance water vessel that is less expensive to manufacture.

BACKGROUND ART

A search of the patent literature has a number of patents directed toward creating flotation chambers. U.S. Pat. No. 4,667,618 Cigognetti, shows a means to form a water tight space between keel and deck elements in an inflatable boat. The keel section 2, and the deck section 1, are joined at the edges to tubes 5, and 6. Tubes 5, and 6, may be either the floats, or float housings.

The following patents show various boat configurations in which there are water tight compartments along at least part of the sides, and which are joined to form a hull.

U.S. Pat. No. 5,699,749 Yamada, shows a personal watercraft in which the hull is provided with a sponson 73, seen best in FIGS. 1, 7, 8, and 9. The assembly appears to be bolted to the remaining parts of the hull.

U.S. Pat. No. 5,546,886 Franceschelli et al, shows a boat built upon hull "T", and deck "C". There are compartments 3, formed in tubular enclosures along each side.

U.S. Pat. No. 5,261,345 Fleming, shows a boat in which inflatable air bladders 2, may be joined to rigid bottom 4 shown in FIG. 2.

U.S. Pat. No. 5,184,566 Cochran, shows a girder type hull to which flotation element 80 is secured.

U.S. Pat. No. 5,078,072 Horiuchi et al, shows a boat formed with a pair of outer sponsons 13, which appear to form water tight portions and hull elements 12.

U.S. Pat. No. 4,781,136 Van Der Velden, shows a cockpit suspended between a pair of water tight sponsons.

U.S. Pat. No. 4,627,372 Douglas, shows a catamaran in which the hull section are formed of sections 11 that are provided on the ends with pointed or streamlined elements 12. The sections 11 are rectangular and mounted so that an edge is at the lowest point so that it forms a keel like configuration.

U.S. Pat. No. 4,348,972 Parsons, shows a three hulled boat in which there is a central hull 12, and a pair of side hulls 32 and 34 which are joined by a deck which is above the waterline.

U.S. Pat. No. 4,192,248 Moyer, shows a hull that is formed from two elements that are joined in the center.

U.S. Pat. No. 4,046,092 Tornqvist, shows a cargo ship hull in which the sides and the bottom of the top deck are joined where the upper wingward spaces 9' and 9", are provided that house pipelines, conveyors, or the like.

U.S. Pat. No. 3,470,839 Faul et al, shows a boat in which there are hull structures on each side and a central bottom portion that is partially in the water.

U.S. 3,140,686 Olivotti, provides a boat with side stabilizing elements "ST", that extend from the side above the level of the water.

U.S. Pat. No. 2,560,153 Blount, shows a boat that is formed of two parallel cylinders that are joined by bulkhead elements 20. Plates 24 and 25 are secured to the cylinders to form the bottom and the deck of the ship. The ends of the cylinders are shaped to form bow and stern configurations.

U.S. Pat. No. 1,303,690 Leparmentier, shows a barge that is formed of two cylindrical floats that are joined by plates a, b, and c. The space between "b", and "c", may be used for liquid cargo or ballast, and the section between "a", and "c", may be used for storage or equipment.

DETAILED DESCRIPTION OF THE PREFERRED EMBODIMENT

Throughout this description reference is made to top and bottom, front and rear. The device of the present invention can, and will in practice, be in numerous positions and orientations. These orientation terms, such as top and bottom, are obviously used for aiding the description and are not meant to limit the invention to any specific orientation.

Figure 1:
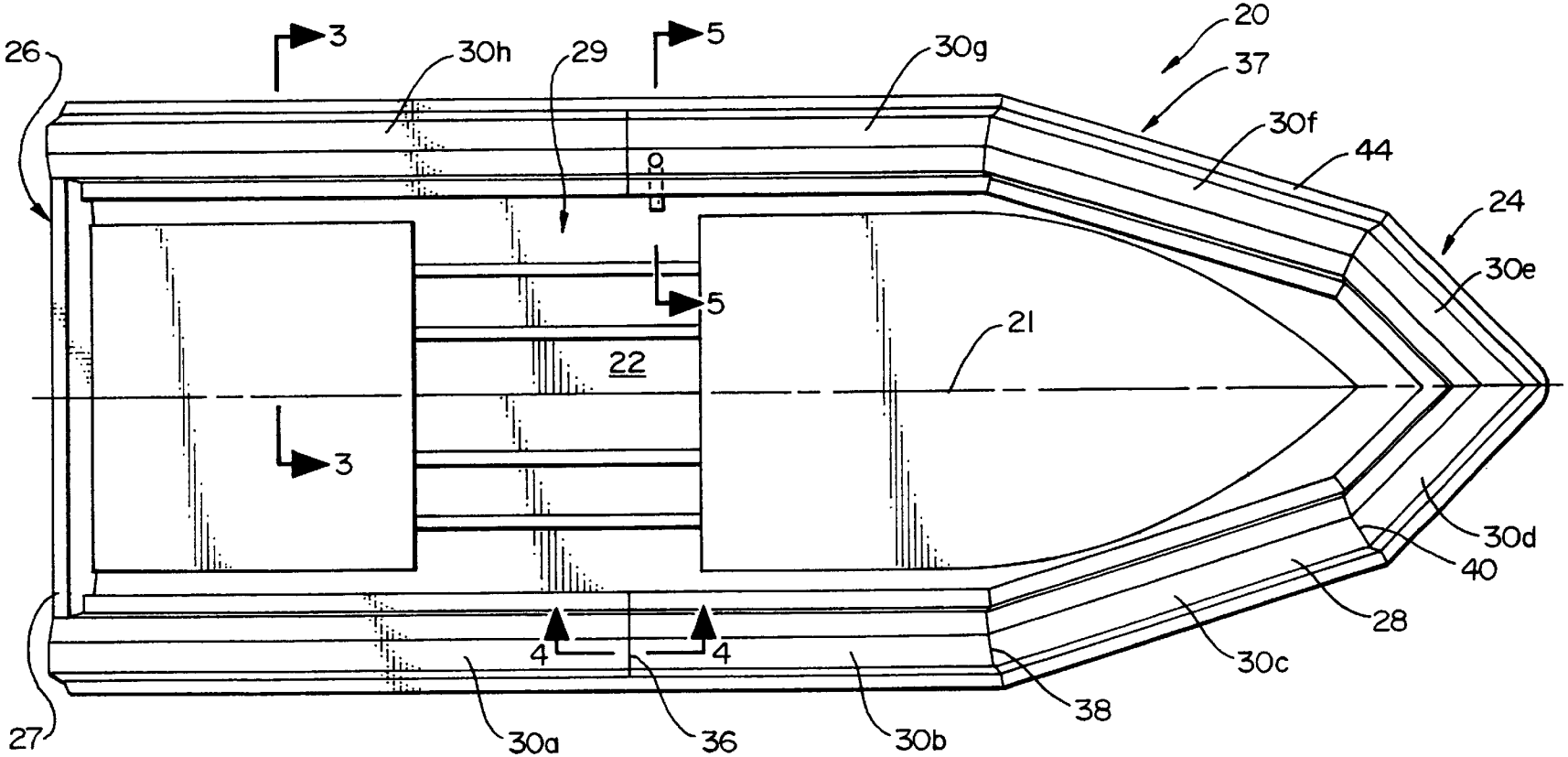
FIG. 1 is a plan view of a the preferred embodiment of a hull configuration.

As seen in FIG. 1, the chambered boat hull comprises a V-shaped bottom wall 22, a bow 24, a stern 26, a rear plate 27, a perimeter hull portion 28 and a central hull portion 29. The chambered boat hull has a longitudinal axis 21 that runs from the bow 24 to the stern 26 and is symmetrically positioned in the center portion of the chambered boat hull as shown in FIG. 1. The chambered boat hull further has a vertical axis running from the upper portion to the lower portion of the chambered hull and a transverse axis running from the center of the chambered hull and extending outwardly in a level plane and perpendicular to the longitudinal axis. The central hull portion is contracted so that a cab or other structure can be mounted thereon.

Figure 5:
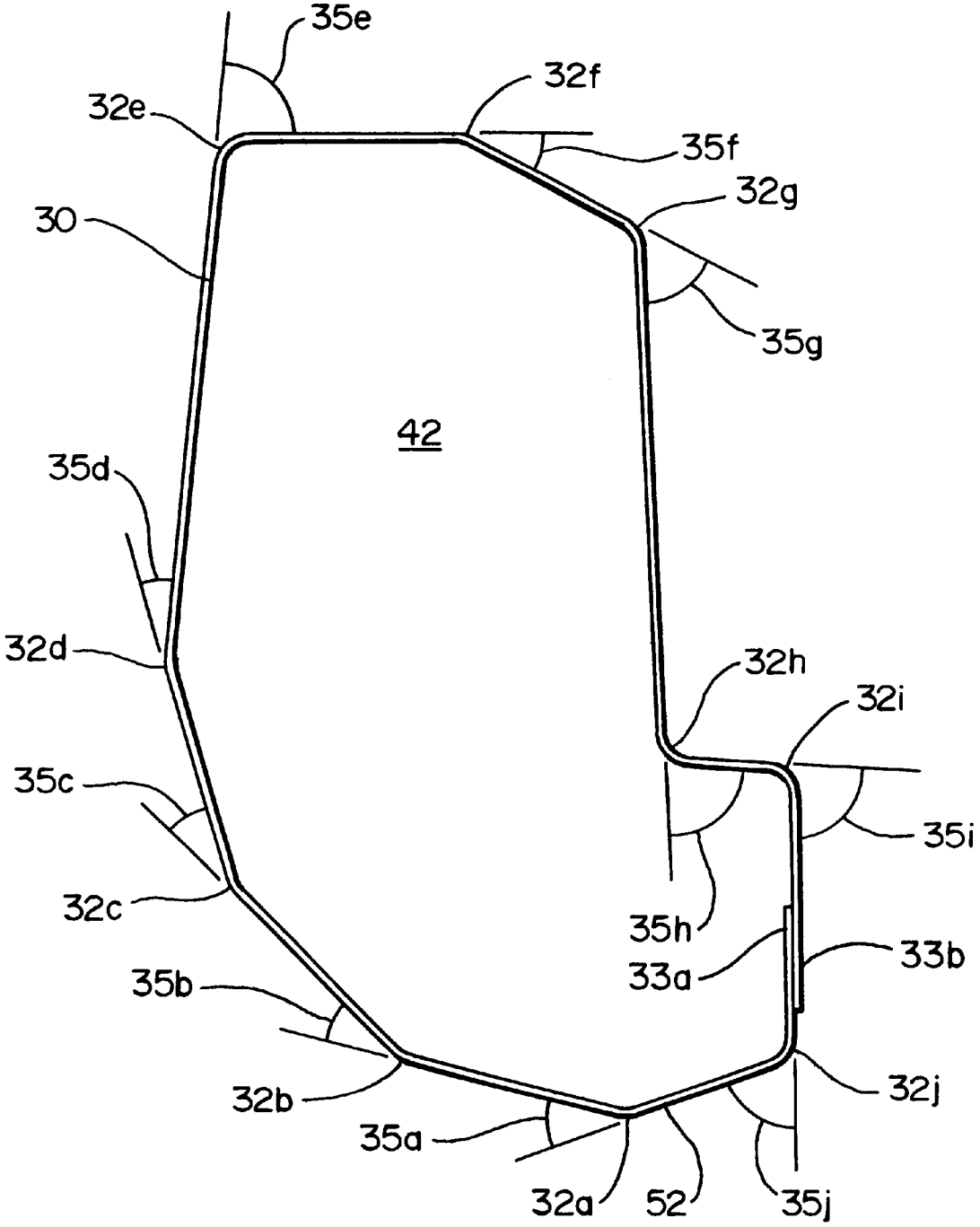
FIG. 5 is a cross sectional view of a multi-creased chamber wall taken at line 5—5 in FIG. 1.

The perimeter hull portion 28 comprises a plurality of multi-creased wall sections 30 that are best seen in FIG. 5. Each of these wall sections have a plurality of creases 32. The wall sections 30 are constructed by taking a flat piece of metal and making several sharp bends at designated locations 32. The end locations 33*a* and 33*b* of the multi-creased wall section 30 over lapped and are welded together to create a seal. The angles of the bends at creases 35 are as follows:

| | |
|---|---|
| 35a | 33° |
| 35b | 30° |
| 35c | 28° |
| 35d | 20° |
| 35e | 85° |
| 35f | 26° |
| 35g | 61° |
| 35h | −85° |
| 35i | 86° |
| 35j | 70° |

Each angle can vary to some degree, and further, more creases can be added without departing from the spirit of the invention.

The angle of surface 52 (35*j*) with respect to the vertical axis has a most desirable range between 80° and 87°, and a secondary desirable range between 75° and 90°. The angle of exterior surface 48 of the V-shaped bottom wall 22 has a most desirable range between 15° and 22°, and a secondary desirable range between 10° and 26°.

Figures 3, 4:
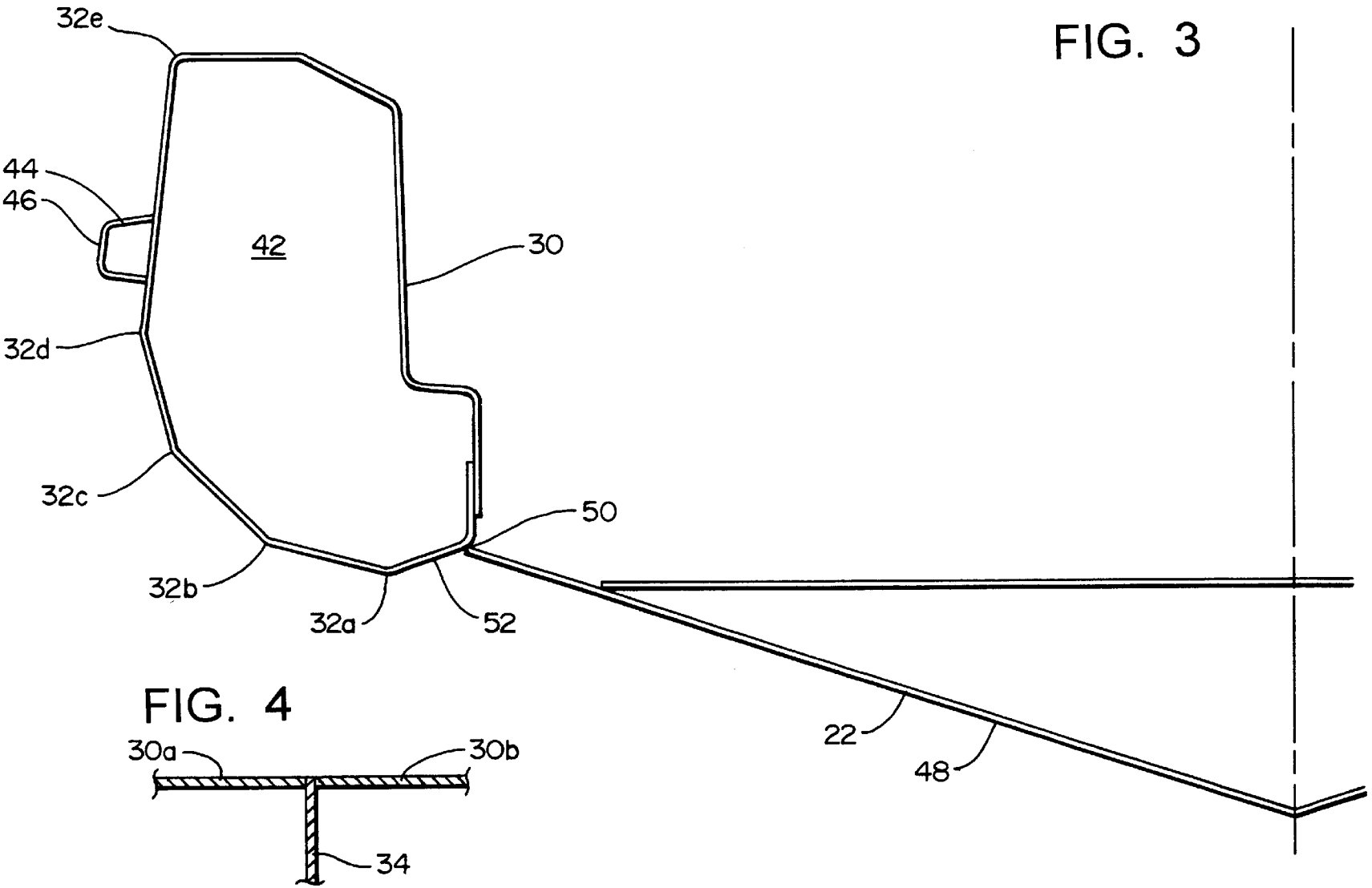
FIG. 3 is a cross sectional view of a the hull side section taken at line 3—3 in FIG. 1.
FIG. 4 is a cross sectional view of a baffle taken at line 4—4 in FIG. 1.

Between each multi-creased wall section 30, there is a baffle 34, which is positioned at the locations indicated at 36, 38 and 40. As seen in FIG. 4, the baffle 34 is connected to multi-creased walls 30*a* and 30*b*. Each pair of proximate baffles 34 in combination with a multi-creased wall sections 30 defines a chamber 42. The chambers 42 are sealed so no water can penetrate therein. The chambers are also pressurized to a 5–16 p.s.i. The internal pressure helps maintain the shape of the multi-creased walls 30 and help prevent the walls from buckling inwardly when the chambers 42 are submerged.

Figure 2:
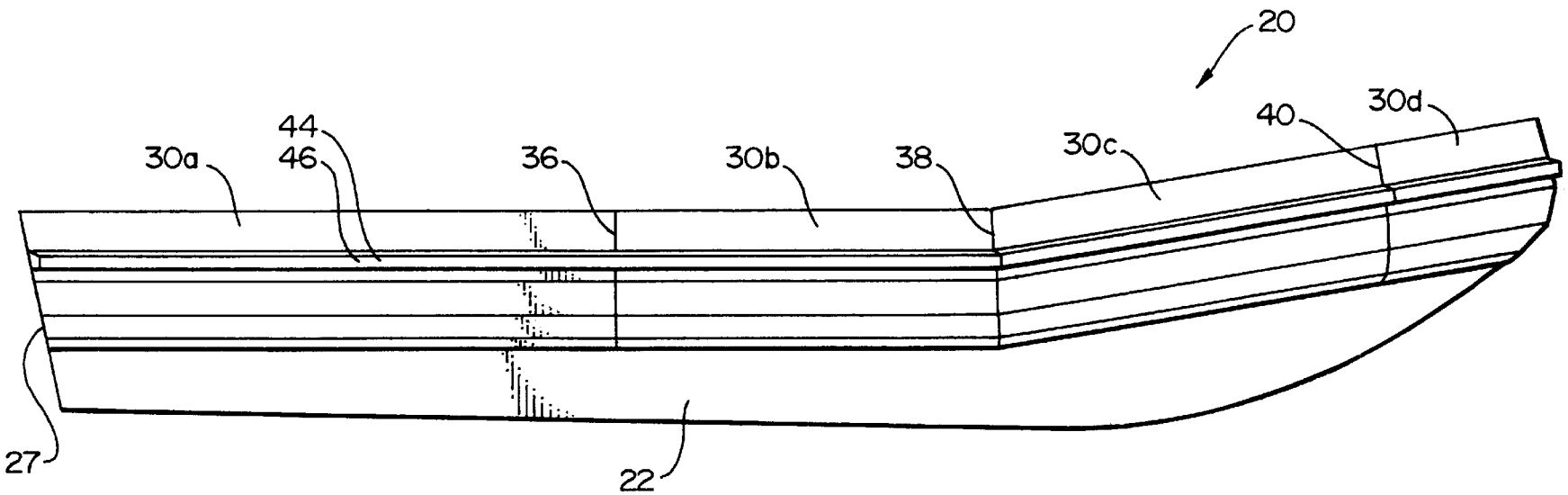
FIG. 2 is a side view of the hull configuration.

Now referring back to FIGS. 1 and 2, in the preferred embodiment the perimeter hull portion 28 comprises 7 discrete chambers. Each chamber is sealed and can provide a buoyant force of hundreds of pounds when they are submerged in water.

Along the outer edge is a multi-creased wall sections 30*a* is a perimeter rim 44 which has an outer contact surface 46 that is adapted to come in contact with obstacles such as docks and other boats before coming in contact with the multi-creased walls 30.

Figures 6, 7, 8:
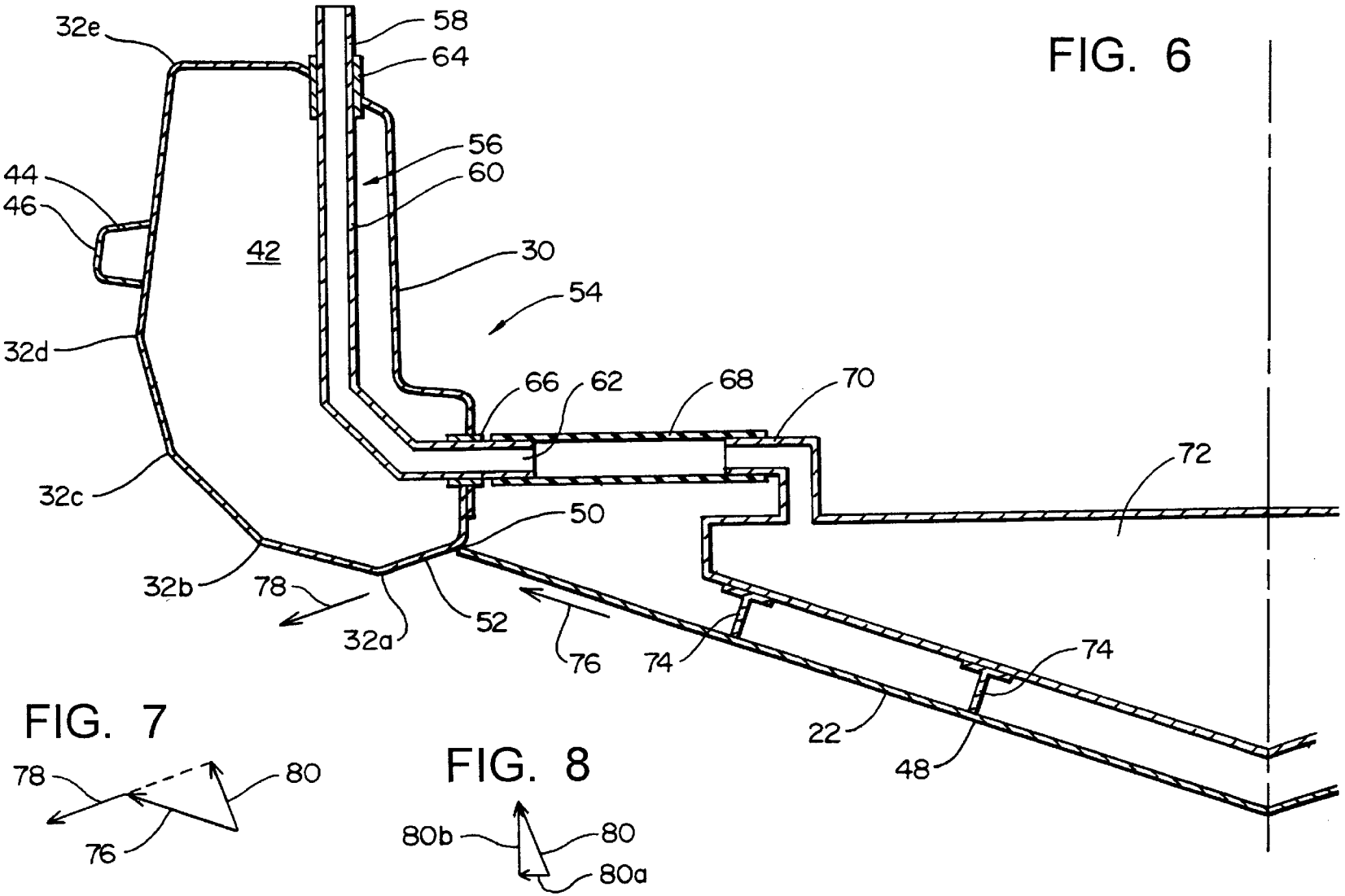
FIG. 6 is a cross sectional view of a fuel insert system taken at line 6—6 in FIG. 1.
FIG. 7 is a vector diagram of the mean fluid velocities of up skirting water.
FIG. 8 is a vector diagram of the vertical and horizontal components of the resultant velocity vector derived from FIG. 7.

The V-shaped bottom wall 22 is located in the lower central hull portion of the chamber hull 20. The V-shaped bottom wall 22 has an exterior surface 48 that is in contact with the water. The V-shaped bottom wall 22 is welded to the multi-creased wall 30 at point 50. Surface 52 is positioned between point 50 and crease 32*a*. As water flows along exterior surface 48 in an upward direction, the water will come in contact with surface 52 which directs the water in a downward direction. The momentum change of the flowing water creates a lift upon the chambered boat hull that results in a smoother ride. The angle between the contact surface 52 and V-shaped bottom wall 22 is approximately 152°. Assuming the water flowing parallel to the V-shaped bottom wall, the water is redirected 38°. The V-shaped bottom wall is approximately 18° from the horizontal plane and the surface 52 is approximately 20° from the horizontal plane. The lift resulting from the flowing water is governed by the momentum equation: $F=m * \Delta/\Delta t$ ;where F=Force, m=mass and $\Delta/\Delta t$=change of velocity with respects to time. In a fluid flow problem such as this the force exerted from changing the direction of a fluid flow is a function of the density of water ρ, times the Volumetric flow rate of the water V, times the velocity change of the water Δv; which is $F_r=\rho\cdot V\cdot\Delta v$. To graphically represent the forces acting upon the chambered hull 20, the vector 76 represents the velocity vector of the mean flow of water traveling up the V-shaped lower wall 22. Likewise the vector 78 represents the mean flow of water off of the surface 50. The vector 78 may be slightly shorter than vector 78 because there are slight losses in the change of direction of the water flow. FIG. 7 shows a resultant vector 80, which is derived from subtracting vector 76 from vector 78. As seen in FIG. 8, this resultant vector 80 comprises a vertical component 80*b* and a horizontal component 80*a*. The vertical component 80*b* is the net change in velocity of the water flow that can be used to calculate the vertical force exerted upon the chambered hull 20; this resultant force being $F_r=\rho\cdot V\cdot$(value of vertical component 80*b*). Other angles could be used for the surface 52 and V-shaped wall 22; however, the angles in the preferred embodiment are particularly advantageous for a desirable fluid flow that has an average resultant force $F_r$ that provides a substantially smoother ride.

A fuel intake system 54 is shown in FIG. 6. The internal passage 56 comprises an intake 58, a central portion 60 and an outlet 62. The intake 58 is housed around the upper sheath 64. The central portion 60 passes through the chamber 42. The outlet 62 is surrounded by lower sheath 66. The upper sheath 64 is welded to the multi-creased chamber wall 30 and the intake 58 is in tight communication to the upper sheath 64. The lower sheath 66 is welded to the multi-creased wall 30 and the outlet 62 is sealed to the lower sheath 66 which seals the chamber 42 so it can withstand a pressure differential between the inside and outside of the chamber 42.

A flexible hose 68 is connected to the outlet 62 and extends to fuel inlet 70 which is connected to fuel tank 72 which is supported above the V-shaped bottom wall 22 by tank supports 74. The location of the fuel tank 72 can be anywhere in the central portion of the hull. Using the flexible hose 68 allows the tank to be positioned in the rear of the boat because generally the fuel tank is in the stern location of the boat.

It is desirable to place the fuel intake system 54 in the central to front portion of the chambered boat hull 20. This provides convenient refueling especially when the boat is loaded in the aft portion of the chambered boat haul and the fuel in the fuel tank 72 builds hydrostatic pressure in the aft portion of the fuel tank because it is positioned lower than the forward portion of the tank allowing fuel to occupy the upper aft portion of the tank 72.

Figure 9:
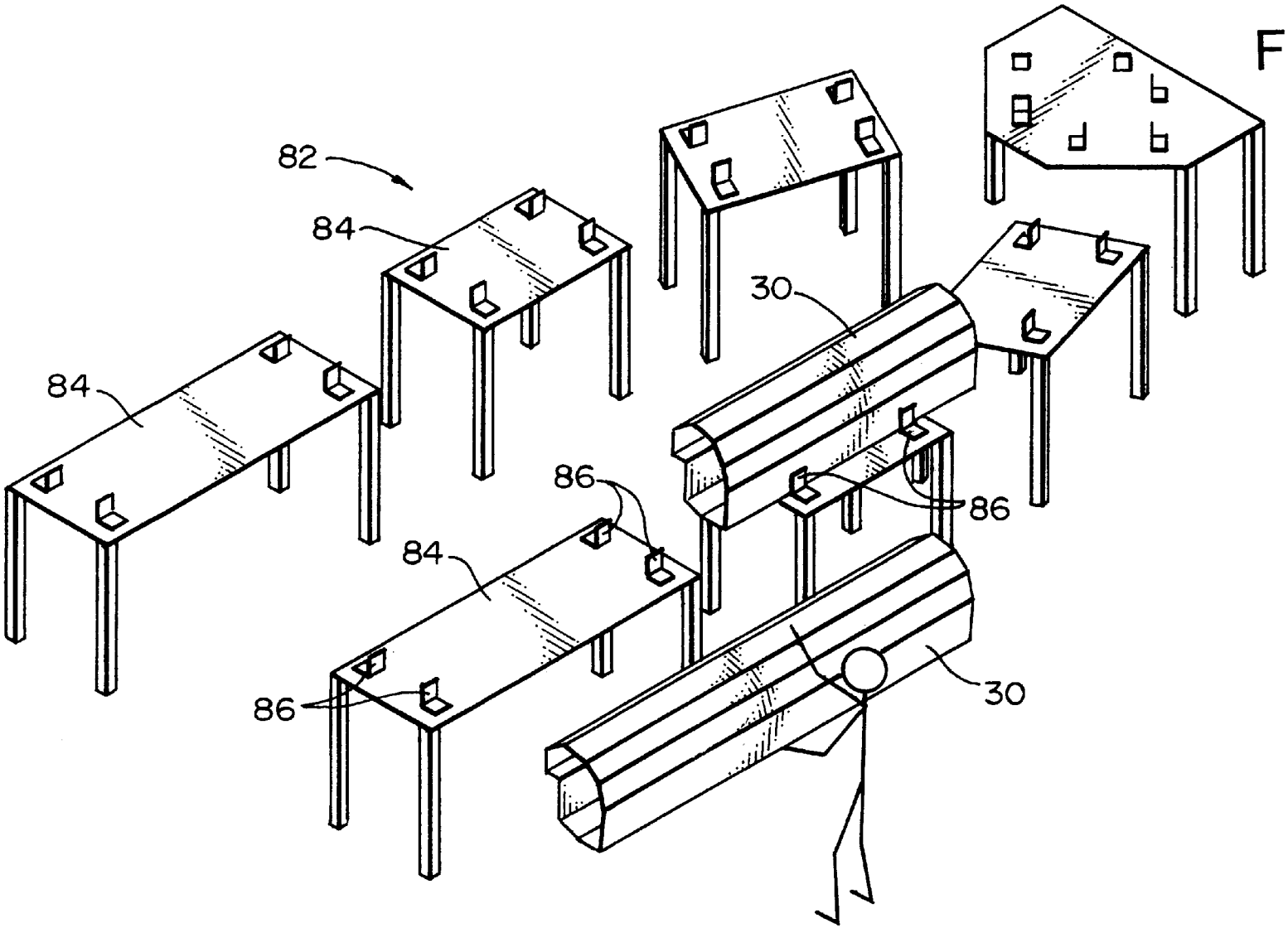
FIG. 9 is a perspective view of a method of manufacture of the aluminum chambered boat hull.

FIG. 9 shows a method of manufacturing the chambered boat hull 20. The assembly 82 comprises a plurality of stationary platforms 84. Located on each platform are placement holders 86. In a manufacturing operation the multi-creased wall sections 30 are placed on the stationary platforms 84 at a location in-between the placement holders 86. A baffle 34 is placed between each multi-creased wall sections 30. The baffle and two adjacent multi-creased wall sections 30 are welded together. This operation creates very consistent dimensions of the boats.

Thereafter the V-shaped bottom wall 22 is welded to the perimeter chamber assembly 37 (see FIG. 1) and the rest of the construction of the boat can take place thereafter.

While the invention is susceptible of various modifications and alternative forms, specific embodiments thereof have been shown by way of example in the drawings and described in detail. It should be understood, however, that it is not intended to limit the invention to the particular forms disclosed, but, on the contrary, the intention is to cover all modifications, equivalents and alternatives falling within the spirit and scope of the invention. Specific embodiments have been shown by way of example in the drawings are described in detail. Its should be understood, however, that it is not intended to limit the invention to the particular forms disclosed, but, on the contrary, the intention is to cover all modifications, equivalents and alternatives falling within the spirit and scope of the invention as expressed in the appended claims.

I claim:

1. A multichambered boat having a central portion and a lateral portion where located in the lateral portion is a flotation chamber that has an upper portion and a laterally inward portion, a fuel storage tank located in the central portion of the multichambered boat:

a fuel input line having an intake nozzle, a central line and an outtake nozzle where the intake nozzle is located in the upper portion of the said flotation chamber and the central line passes therethrough the flotation chamber, the outtake nozzle is located on the laterally inward portion of the flotation chamber, a second line in communication with the outtake nozzle of the fuel input line and further in communication with the fuel storage tank.

2. The apparatus as recited in claim 1 further comprising:

where the fuel input line is housed within one of the central chambers of the multichambered boat.

3. A method of constructing a multi-chambered boat, the method comprising:

a) positioning a plurality of stationary platforms that each have placement holders attached thereon which are adapted to hold multi-creased wall sections in a preassembled arrangement;

b) placing a baffle between a first and second multi-creased wall sections and welding the baffle to the perimeter edges of the multi-creased wall sections;

c) said method being characterized in that the second multi-creased wall section is adjacent to the first multi-creased wall section so the perimeter edge of the second creased wall section is in a positioned alignment with the perimeter edge of the first creased wall section;

d) whereas the preassembled arrangement of the multi-creased wall sections is upside-down than the final operational position of the multi-chambered boat.

4. The method as recited in claim 3, wherein additional baffles are placed between other adjacent wall sections with the other adjacent wall sections having perimeter edges thereof in alignment with one another, said method further comprising welding the baffles to adjacent perimeter edges of the adjacent multi-creased wall sections.

5. The method as recited in claim 4, wherein the preassembled arrangement of the multi-creased wall sections is arranged with at least some of the multi-chambered wall sections being positioned at two opposite side locations corresponding to two side locations of the boat that is being constructed.

6. The method as recited in claim 5, wherein forward multi-creased wall sections in the preassembled arrangement have forward adjacent end portions, said method further comprising joining the forward end portions of the forward multi-creased wall sections to one another.

7. The method as recited in claim 5, wherein forward multi-creased wall sections in the preassembled arrangement are positioned to converge toward one another to conform to a configuration of the boat that is being constructed.

8. The method as recited in claim 7, wherein a central hull structure corresponding to a central hull portion of the multi-chambered boat being constructed is positioned between the side portions of the multi-creased wall sections and welded to the multi-chambered wall sections.

9. The method as recited in claim 8, wherein said central hull structure is configured as a V-shaped bottom hull portion comprising first and second bottom wall sections joining at a center location, with each bottom wall section having an outer edge portion, said method further comprising welding the outer edges of the bottom wall edge portions to lower inside surface portions of the multi-chambered wall sections in a manner that each bottom wall edge portion is adjacent to a downwardly and laterally outwardly sloping bottom surface portion of the multi-chambered wall sections at the side locations, whereby two longitudinally extended recesses are formed, whereby with the boat travelling through water, the water is directed in a lateral and upward direction to the longitudinal recesses, with the water being redirected laterally and downwardly to provide lift.

10. A method of constructing a boat hull having a central hull portion and a metal multi-chambered perimeter hull portion having a hull perimeter configuration and extending at least along opposite sides of the central hull portion to a forward hull location, said method comprising:

a) providing a platform assembly comprising a plurality of placement holders which are adapted to hold multi-creased wall sections in a preassembly holder arrangement corresponding to said hull perimeter configuration;

b) positioning metal, multi-creased wall sections in the placement holders in a preassembled arrangement, with each multi-creased wall section having a lengthwise axis and being formed in a surrounding wall configuration, each multi-creased wall section having a plurality of creases which are generally aligned along the lengthwise axis, and along which the multi-creased wall section is bent at crease locations, with each multi-chambered wall section comprising sidewall portions located between proximate crease locations, and with each multi-creased wall section having oppositely located end perimeter portions;

c) positioning baffles between adjacent end perimeter portions of adjacent multi-creased wall sections, with end perimeter edges of adjacent multi-chambered wall sections being positioned in adjacent alignment with one another;

d) welding each baffle to adjacent perimeter portions of adjacent multi-chambered wall sections to form a plurality of perimeter hull chambers as a preform hull perimeter structure;

e) and providing a central hull structure positioned between side portions of the preform perimeter hull structure and welding the central hull structure to the preform perimeter hull structure.

11. The method as recited in claim 10, wherein forward multi-creased wall sections in the preassembled arrangement have forward adjacent end portions, said method further comprising joining the forward end portions of the forward multi-creased wall sections to one another.

12. The method as recited in claim 10, wherein forward multi-creased wall sections in the preassembled arrangement are positioned to converge toward one another to conform to a configuration of the boat that is being constructed.

13. The method as recited in claim 10, wherein said central hull structure is configured as a V-shaped bottom hull portion comprising first and second bottom wall sections joining at a center location, with each bottom wall section having an outer edge portion, said method further comprising welding the outer edges of the bottom wall edge portions to lower inside surface portions of the multi-chambered wall sections in a manner that each bottom wall edge portion is adjacent to a downwardly and laterally outwardly sloping bottom surface portion of the multi-chambered wall sections at the side locations, whereby two longitudinally extended recesses are formed, whereby with the boat travelling through water, the water is directed in a lateral and upward direction to the longitudinal recesses, with the water being redirected laterally and downwardly to provide lift.

14. A method of constructing a metal multi-chambered perimeter hull section of a boat hull where the multi-chambered perimeter hull section comprises two perimeter side portions and a forward perimeter portion defining a central region in which a central hull portion is located, said method comprising:

a) providing a platform assembly having a plurality of placement holders which are adapted to hold multi-creased wall sections in a preassembled holder arrangement corresponding to said hull perimeter configuration;

b) positioning multi-chambered wall sections in the placement holders in a preassembled perimeter arrangement, with each of said multi-chambered wall sections being formed as a surrounding wall configuration having a plurality of creases along which the multi-creased wall section is bent at crease locations, with each multi-chambered wall section portions located between proximate crease locations, and with each multi-creased wall section having oppositely positioned end perimeter portions;

c) positioning baffles between each adjacent end perimeter portions and adjacent multi-chambered wall sections, with end perimeter edges of the adjacent multi-chambered wall sections being in a positioned alignment with one another;

d) welding each baffle to its adjacent end perimeter portions of the adjacent multi-chambered wall sections to form a plurality of hull floatation chambers which form said multi-chambered perimeter hull section.

15. The method as recited in claim 14, wherein forward multi-creased wall sections in the preassembled arrangement have forward adjacent end portions, said method further comprising joining the forward end portions of the forward multi-creased wall sections to one another.

16. The method as recited in claim 14, wherein forward multi-creased wall sections in the preassembled arrangement are positioned to converge toward one another to conform to a configuration of the boat that is being constructed.

17. A boat hull comprising:

a) a central hull portion;

b) a metal multi-chambered perimeter hull portion having two side hull portions which are on opposite sides of the central hull portion, and which have forward perimeter hull portions converging toward one another at a forward end portion of the boat hull;

c) said perimeter hull portion comprising:

i. a plurality of multi-creased wall sections, each of which has a lengthwise axis, and each formed from a related metal sheet in a surrounding wall configuration by being bent along a plurality of generally lengthwise creases, with wall section portions extending between adjacent pairs of said creases;

ii. said multi-creased wall sections each having end perimeter edge portions with adjacent end perimeter edge portions of adjacent multi-chambered wall sections being adjacent to one another in end-to-end relationship at a perimeter juncture location;

iii. a plurality of baffles, with each baffle being positioned at a related perimeter juncture location, with a perimeter edge of the baffle being adjacent to the end perimeter edge portions of adjacent multi-chambered wall sections, and with the adjacent end perimeter edge portions and the perimeter edge of the adjacent baffle being welded together to form a watertight seal, and with the adjacent baffle making an air seal between interior regions of adjacent multi-chambered wall sections;

iv. said multi-chambered wall sections and said baffles thus being joined together to provide a plurality of airtight floatation chambers, with each chamber being enclosed by a related wall section and two related end baffles, with weld connections at the related end baffles forming an airtight connection.

18. The boat hull as recited in claim 17, wherein the perimeter hull portion has an upper portion, a lower portion, an outer side portion further from a central longitudinal axis, and an inner side portion closer to said central longitudinal axis, at least side portions of said perimeter hull portion having a cross-sectional configuration such that the outer sidewall portions each comprise an upper generally vertical sidewall portion, and a lower outer sidewall portion which comprises a plurality of adjacent lower outside wall section portions, each of which makes an angle with a horizontal axis of the boat hull, with said lower outside wall portions being arranged so that any lower outside wall portion at a higher location makes a greater angle with said horizontal axis than any lower outer sidewall portion at a lower location, so that said plurality of lower outside wall portions of each outer sidewall portion collectively define a lower outside surface contour following a downwardly and inwardly curved alignment.

19. The boat hull as recited in claim 17, wherein the perimeter hull portion has an upper portion, a lower portion, an outer side portion further from a central longitudinal axis, and an inner side portion closer to said central longitudinal axis, at least side portions of said perimeter hull portion have a cross-sectional configuration being such that the lower portion of each perimeter hull portion has an inner lower portions closer to the longitudinal center axis, and these lower inner portions extend at a laterally inward and upward slant toward said longitudinal center axis, the central hull portion comprises a V-shaped hull portion having upwardly and outwardly slanting central hull walls, and each inner lower portion forms with an adjacent wall section of the central hull portion, a longitudinal recess, whereby two longitudinally extended recesses are formed, whereby with the boat travelling through water, the water is directed in a lateral and upward direction to the longitudinal recesses, with the water being redirected laterally and downwardly to provide lift.

20. The boat hull as recited in claim 17, wherein the perimeter hull portion has an upper portion, a lower portion, an outer side portion further from a central longitudinal axis, and an inner side portion closer to said central longitudinal axis, at least side portions of said perimeter hull portion have a cross-sectional configuration being such that the inner side portion has an upper inside portion that is substantially vertical, and a lower inside portion which also has a substantial vertical alignment component that is located further inwardly toward the longitudinal center axis and the upper portion of the inner side portion, said upper and lower inner side portions being connected by a connecting wall portion having a substantial horizontal alignment component interconnecting a lower part of the upper inside portion with an upper part of the lower inside portion.

* * * * *